United States Patent [19]

Rappen

[11] Patent Number: 5,074,472

[45] Date of Patent: Dec. 24, 1991

[54] MIST SPRAYING DEVICE

[75] Inventor: Albert Rappen, Muelheim, Fed. Rep. of Germany

[73] Assignee: VSR Engineering GmbH

[21] Appl. No.: 495,573

[22] Filed: Mar. 19, 1990

[30] Foreign Application Priority Data

Mar. 18, 1989 [DE] Fed. Rep. of Germany ..... 3909008

[51] Int. Cl.[5] ..... B05B 15/08; B05B 15/04; B05B 1/28

[52] U.S. Cl. ..... 239/587; 239/283; 239/288.5; 239/533.13

[58] Field of Search ..... 239/288, 288.3, 288.5, 239/587, 268, 269, 538, 273, 275, 282, 283, 104, 120, 533.1, 533.13; 118/323

[56] References Cited

U.S. PATENT DOCUMENTS

| | | | |
|---|---|---|---|
| 1,182,898 | 5/1916 | Eilertsen | 239/282 |
| 2,392,085 | 1/1946 | Ferrel | 239/533.13 |
| 2,633,383 | 3/1953 | Marmor | 239/282 |
| 2,946,521 | 7/1960 | McEachern | 239/273 |
| 2,978,187 | 4/1961 | Hesson | 239/288.5 |
| 3,313,353 | 4/1967 | Williamson et al. | 239/288 |
| 3,850,373 | 11/1974 | Grolitsch | 239/288.5 |
| 3,874,595 | 4/1975 | Rindisbacher | 239/104 |

*Primary Examiner*—Andres Kashnikow
*Assistant Examiner*—Christopher G. Trainor
*Attorney, Agent, or Firm*—Longacre & White

[57] ABSTRACT

This invention is for a mist spraying device which is comprised of a multi-medium nozzle which is attached within a mist spray bowl to an adapter head by which the device is connected to the media supply lines. The adapter head can be swivelled about an axis which forms an angle $\alpha$ of between 15° and 45° with respect to a central axis of the mist spray bowl.

13 Claims, 3 Drawing Sheets

MIST SPRAYING DEVICE

BACKGROUND AND SUMMARY OF THE INVENTION

The invention relates to a mist spraying device, featuring a multi-medium nozzle .within a mist spraying bowl which is attached to an adapter head, the latter forming the connection to the medium supply lines.

Such spraying devices, which can direct water in the form of a fine mist, are used in bulk material conveying plants or similar dusty environments in order to contain the dust.

A particularly efficacious mist-producing effect of the water can be achieved by allowing compressed air to flow out from a so-called resonance chamber and then injecting water under pressure. The result is that water in the form of minute mist particles emerges therefrom, achieving an extremely effective precipitation of the dust particles or of odorous aerosols.

By reason of the fineness of these mist particles, they are particularly sensitive to troublesome air currents. Therefore, it is vital to stabilize and balance the air flow in the vicinity of the spraying nozzle, and at the same time to direct the mist spray into the dust-laden atmosphere in such a way that there is optimum distribution of the mist clouds as well as binding of the dust particles.

In addition, the spraying nozzle must be protected against damage by coarse particles, and should be readily accessible to permit simple and safe inspection as well as easy installation/removal and connection to the compressed air and water lines. Furthermore, any caking and clogging of the nozzle due to bound o caked dust must be prevented.

These tasks are accomplished by this invention in such a manner that the adapter head may be swivelled about an axis which forms an angle of 15 to 45 degrees with the central axis of the nozzle passing through the centre point of the bowl.

Further provision is made for the swivel axis to form an angle of between 15° and 45° with the bowl central axis.

Both angles are advantageously equal to approximately 30°. Thus, by swivelling the adapter head, the nozzle axis can be rotated from 0 to 60° with respect to the bowl central axis. By twisting back the bowl, the nozzle axis can be maintained in its plane.

To ensure a directionally accurate mist cloud spray which is not affected by cross-currents, the spraying nozzle bowl can be advantageously designed as a half-shell which is characterized by a cylindrical periphery with a height approximately equivalent to 50% of the length of the bowl diameter.

As a further means of removing any deposits and/or caking, a nozzle through which pulses of compressed air can be advantageously passed is arranged within the bowl, with its central axis similarly directed towards the bowl central point, whereby the air nozzle is characterized by a periphery which forms an annular slot with the bowl internal surface, through which additional air can emerge tangentially over the bowl internal surface, and whereby the air nozzle is connected to a compressed air accumulator with quick-action relief valve.

The actual air jet nozzle can be made of some flexible material which permits automatic opening of both the central jet orifice and the annular slot if there is any internal pressure build-up.

The spray nozzle bowl can be advantageously installed and dismantled if it has a securing flange comprising a flat ring and a securing collar which connects the flat ring to the bowl. The securing collar is thereby advantageously firmly connected to the bowl, for instance, by welding, with the flat ring connected or connectable to the housing or to a wall of the location to be de-dusted, and with the securing collar and flat ring pivotable and fixable with respect to each other, for example, by means of a screw connection, when the bowl is turned.

A further design of the invention provides for a flexible clamping collar to be arranged between the flat ring and the securing collar, in order to facilitate the installation and alignment of the mist spraying device.

An advantageous design of the clamping collar is characterized by its having an inner part connectable to the securing collar, comprising two clamping jaws, by means of which the securing collar can be gripped on both sides and which can become rigid after insertion of the securing collar, and also characterized by its having an outer part which accommodates the flat ring, comprising a fixed jaw which is only flexible at its open end, and a flexible-type connected jaw, the main axis of which is inclined towards the circular flat ring to be held, and for the insertion of which can be pressed inwards and following the insertion is resiliently held.

As stiffening, for example, a grommet can be pressed in to connect the clamping collar permanently and tightly with the securing collar.

The flexible jaw permits easy pressing of the bowl into the opening of the flat ring or alternatively into an opening cut directly in a housing, whereby the wall thickness of this housing corresponds approximately to the thickness of the flat ring.

This further achieves the advantage that the bowl can only be removed again from the clamping collar by use of additional force. By having a circular design of securing collar, flat ring and clamping collar, the spray nozzle bowl can thus be easily turned in any desired position, and accurately adjusted to optimize the direction of the mist spray cloud.

Naturally, the clamping collar can also be designed such that the flexible jaw is on the inside instead of the outside of the collar.

Finally, the rotating of the adapter head with respect to the medium supply lines is advantageously facilitated in that the adapter head outside the bowl has at least one connecting piece designed as a screw collar ring which can be rotated round its swivel axis and in that at least one of the surfaces between the connecting piece and the head which turn with respect to each other is provided with annular grooves with edge seals facing towards the media lines in all the various positions.

The mist spraying device according to the invention facilitates in a most simple manner any desired directing of the mist spray and permits ready access from the outside, which considerably improves the facility of the spray nozzle bowl without any great expenditure.

BRIEF DESCRIPTION OF THE DRAWINGS

In the following paragraphs, three design examples of the invention are explained with the use of drawings as follows.

DETAILED DESCRIPTION OF THE DRAWINGS

Figure 1:
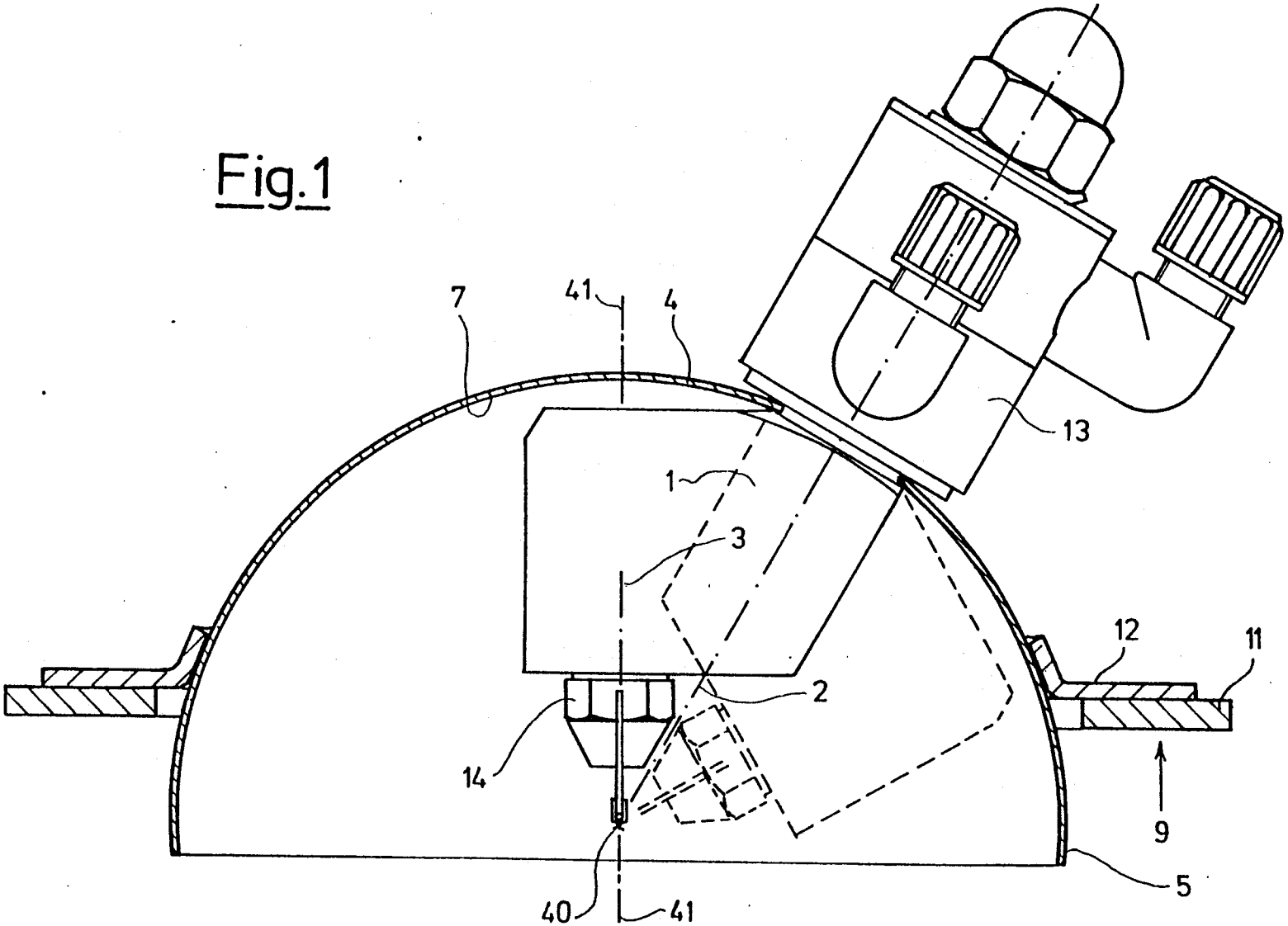
FIG. 1 is a sectional view of a mist spraying device.

In accordance with the drawings, the mist spraying device comprises a bowl (4) in the form of a half shell of rigid material, which has a cylindrical periphery (5), the said periphery with a height approximately equivalent to 50% of the length of the bowl diameter. The bowl (4) is mounted in the wall of a location to be de-dusted by means of a securing collar (12) and a flat ring (11).

Within the bowl (4) and mounted on an adapter head (1) is a multi-medium nozzle (14), the central axis (3), i.e., the outlet direction of the spraying medium of which, is permanently directed towards the centre point (40) of the bowl (4) and with respect to the adapter head axis in the above embodiments is offset by angle $\alpha$ approximately 30°. The adapter head (1) can be swivelled through an axis (2) which likewise passes through the centre point (40), the axis (2) similarly forming an angle $\beta$ of approximately 30° with the bowl central axis (41). Other angles $\alpha$ and $\beta$ within the range between 15° and 45° are also possible as required.

The adapter head can be swivelled with respect to its connecting pieces (13) and designed such that the passage of the media, advantageously air and water, is guaranteed whatever the swivel position. The corresponding design is left to the choice of the specialist, i.e., it can be effected by either annular grooves or annular slots with edge seals. As a result, the opposing surface need have an outlet only in the vicinity of the groove/-slot opening. Securing of the adapter head with respect to the swivel connecting piece (13) can then be effected by a nut 13'.

Figure 2:
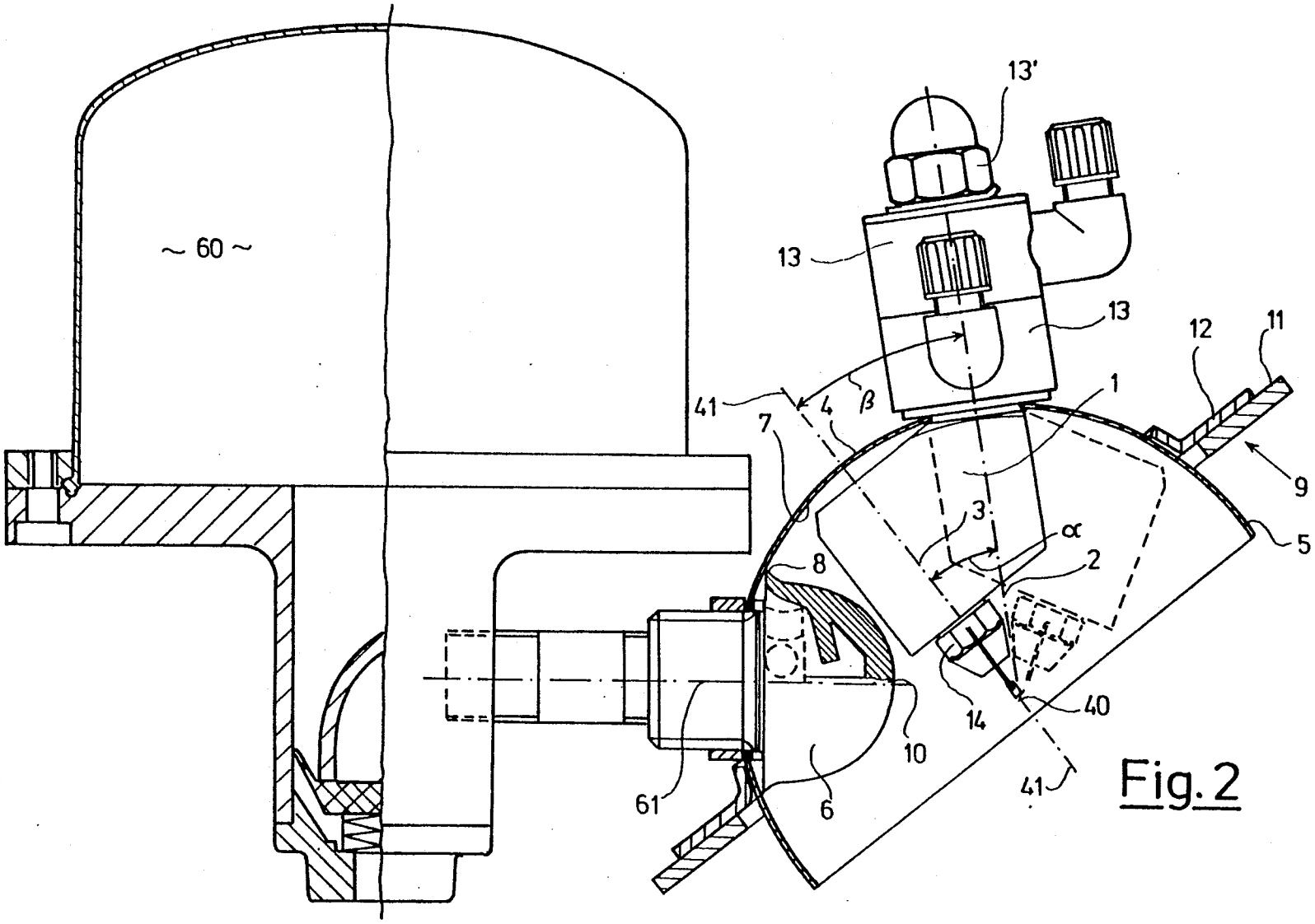
FIG. 2 is the device according to FIG. 1 with an additional air cleaning nozzle.

In accordance with FIG. 2, a further air nozzle (6) made of flexible material can be mounted within the bowl (4) which has a central nozzle orifice (10) and a periphery adjacent to the bowl inner surface (7), whereby following build-up of internal pressure, the central nozzle orifice (10) opens, and the periphery (5) is lifted from the inner surface of the bowl on creation of an annular slot. By means of this nozzle, removal of deposits, caking, etc., can be effected if compressed air, preferably in pulses, is supplied appropriately.

Figure 3:
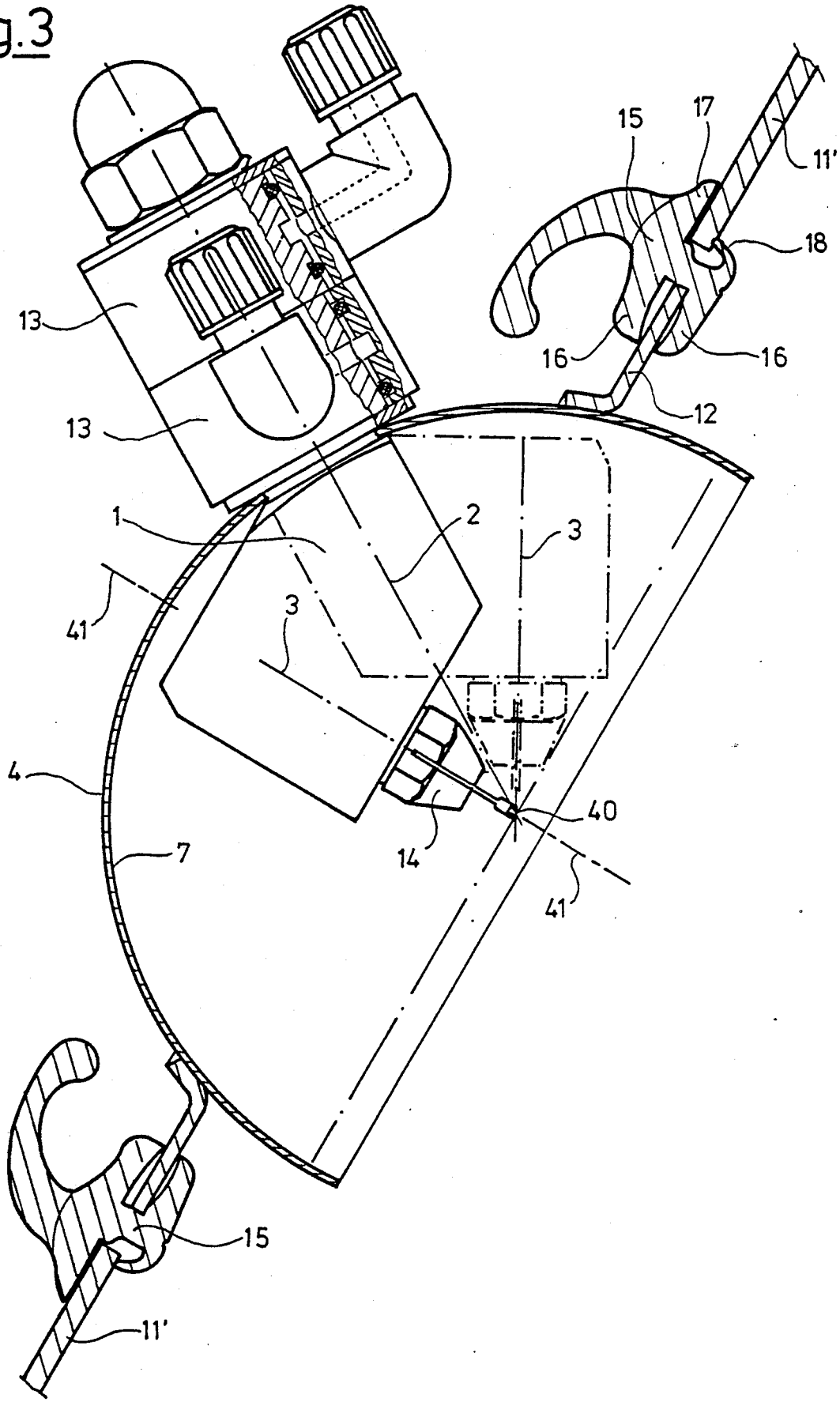
FIG. 3 is a third design of the device.

FIG. 3 shows a design of mist spraying device with a flexible clamping collar (15) arranged between the securing collar (12) and a receptacle wall (11) with a circular cut-out replacing the flat ring. On its inner side facing the securing collar (12), the circular clamping collar (15) has two quite sturdy and essentially rigid jaws (16) which together form a groove to accommodate the outer part of the securing collar (12). To safeguard the connection between securing collar (12) and clamping collar (15), a grommet, for example, can be pressed between the jaws (16) and collar (15) after insertion of the securing collar (12).

On its outer periphery, the clamping collar (15) has two differently-shaped jaws (17) and (18), whereby jaw (17) has similar shapes and dimensions to those of jaw (16), whereas jaw (18) is a flexible design and has a main axis which is inclined in respect of the circular periphery of the flat ring (11) to be secured.

The particular design of the clamping collar (15) achieves the effect that the complete mist spraying device with adapter head (1) and bowl (4), including securing collar (12) with attached clamping collar (15) can be pressed into the circular opening in the flat ring (11) from one side, i.e., from the left in FIG. 3. On insertion, the flexible jaw (18) gives way inwards, springing resiliently back into its original position as shown in FIG. 3 on completion of the insertion operation. Considerably more force has to be applied to remove the mist spraying nozzle, since greater forces are needed to deform the jaw (18).

By turning the adapter head as well as the whole bowl, the outlet flow axis can be varied over a wide range of positions, so that optimum distribution of the mist spray within the location to be de-dusted can be achieved, whereby subsequent fine adjustment or optimization can be achieved according to the mist spray or dust-laden air flow.

The connections between the water and air channels of the adapter head and the water/air lines are designed so that they can maintain their direction irrespective of the position of the adapter.

What is claimed:

1. A mist spraying device, comprising a multi-medium, said nozzle attached within a mist spray bowl to an adpater head by means of which said device is connected with media supply lines, wherein said adapter head can be swivelled about an axis which forms an angle $\alpha$ of between 15° and 45° with an axis of said nozzle passing through a center point of said mist spray bowl.

2. The mist spraying device according to claim 1, wherein the swivel axis of said adapter head forms an angle $\beta$ between 15° and 45° with a central axis of said bowl.

3. The mist spraying device according to claim 2, wherein the angles $\alpha$ and $\beta$ are each 30°.

4. The mist spraying device according to claim 1, wherein the mist spray bowl forms a half shell said half shell having a hemispherical periphery.

5. The mist spraying device according to claim 4, wherein the hemispherical periphery has a height equal to about 50% of the length of the bowl diameter.

6. The mist spraying device according to claim 1, further comprised of an air nozzle mounted within said bowl, wherein a central nozzle orifice of said air nozzle is directed towards the center point of said bowl.

7. The mist spraying device according to claim 6, wherein the air nozzle has a periphery which forms an annular slot with an internal surface of said bowl to provide an additional tangential air outlet.

8. The mist spraying device according to claim 7, wherein said air nozzle is comprised of a flexible material, thereby permitting automatic opening of said central nozzle orifice of said air nozzle and the annular slot upon an internal build-up of pressure in said air nozzle.

9. The mist spraying device according to claim 1, wherein said mist spray bowl is further comprised of a connecting flange, said connecting flange surrounding said periphery of said bowl and being comprised of a flat ring and a securing collar, said securing collar connecting the flat ring to the bowl.

10. The mist spraying device according to claim 9, being further comprised of a flexible clamping collar fitted between the flat ring and the securing collar.

11. The mist spraying device according to claim 10, wherein the clamping collar is further comprised of an inner part fixable to the securing collar, said inner part being comprised of two clamping jaws by which the securing collar can be gripped on both sides, and an outer part to accomodate the flat ring, said outer part being comprised of a rigid jaw and a flexible-type connected jaw, said flexible-type connected jaw having an axis inclined with respect to the flat ring, wherein upon connection of the flat ring with said flexible-type connected jaw, said flexible jaw gives way inwards to allow the flat ring to move between the rigid jaw and the flexible-type connected jaw.

12. The mist spraying device according to claim 1, wherein the adapter head outside the bowl is further comprised of at least one connecting piece which is designed as a screw collar ring rotatable around the swivel axis of said adapter head.

13. The mist spraying device according to claim 7, wherein said air nozzle is connected to a compressed air accumulator with a quick-action relief valve.

* * * * *